US008261511B1

(12) United States Patent
Kirby

(10) Patent No.: US 8,261,511 B1
(45) Date of Patent: Sep. 11, 2012

(54) METHOD AND APPARATUS FOR MAKING SLOPED CONCRETE FLOORS

(76) Inventor: Mark E. Kirby, Clearwater, FL (US)

( * ) Notice: Subject to any disclaimer, the term of this patent is extended or adjusted under 35 U.S.C. 154(b) by 71 days.

(21) Appl. No.: 12/794,070

(22) Filed: Jun. 4, 2010

(51) Int. Cl.
*E04G 21/16* (2006.01)
*E04G 21/00* (2006.01)
*E04F 21/00* (2006.01)

(52) U.S. Cl. ..... 52/749.1; 52/749.13

(58) Field of Classification Search ..... 52/126.1, 52/126.3, 126.4, 126.5, 126.6, 126.7, 167.4, 52/DIG. 1, 364, 365, 367, 371, 749.13, 741.41, 52/749.1; 33/526, 527
See application file for complete search history.

(56) References Cited

U.S. PATENT DOCUMENTS

| | | | | | |
|---|---|---|---|---|---|
| 3,127,703 | A * | 4/1964 | Eshelman | 52/365 |
| 3,511,001 | A * | 5/1970 | Morgan, Jr. | 52/126.5 |
| 4,439,961 | A * | 4/1984 | Witte | 52/126.1 |
| 5,263,260 | A * | 11/1993 | Smith | 33/526 |
| 5,661,931 | A * | 9/1997 | Johansson | 52/126.7 |
| 5,832,619 | A * | 11/1998 | Volkema, Jr. | 33/527 |
| 6,088,984 | A * | 7/2000 | Kirby | 52/302.1 |
| 6,155,015 | A * | 12/2000 | Kirby | 52/302.1 |
| 6,412,185 | B1 * | 7/2002 | Mills et al. | 33/526 |
| 6,481,111 | B1 * | 11/2002 | Myrick | 33/526 |
| 6,568,140 | B2 * | 5/2003 | Kirby | 52/302.1 |
| 6,625,951 | B1 * | 9/2003 | McCarthy | 52/747.1 |
| 6,848,229 | B2 * | 2/2005 | Rossi | 52/367 |
| 7,070,667 | B1 * | 7/2006 | Kirby | 156/71 |
| 7,257,926 | B1 * | 8/2007 | Kirby et al. | 52/126.5 |
| 2001/0034946 | A1 * | 11/2001 | Hamdorf | 33/451 |
| 2002/0174607 | A1 * | 11/2002 | Omundson | 52/127.5 |
| 2003/0037497 | A1 * | 2/2003 | Kirby | 52/302.1 |
| 2006/0185319 | A1 * | 8/2006 | Kufner et al. | 52/749.11 |
| 2010/0139196 | A1 * | 6/2010 | Healy | 52/365 |
| 2011/0232207 | A1 * | 9/2011 | Duke | 52/126.6 |

* cited by examiner

*Primary Examiner* — Basil Katcheves
*Assistant Examiner* — Rodney Mintz
(74) *Attorney, Agent, or Firm* — Ronald E. Smith; Smith & Hopen, P.A.

(57) ABSTRACT

A tool for changing a substantially level or unlevel floor to a sloped floor having a predetermined slope includes a float stick formed of a rigid, cuttable material so that it can be cut to length as required by the size of the floor. The float stick has a sloped top edge and a flat bottom edge. The sloped top edge slopes downwardly from a proximal end to a distal end of the float stick at a predetermined slope per linear unit. A spirit level is mounted to the float stick and is calibrated so that its bubble is centered when the flat bottom edge is level. At least one vertical bore is formed in the float stick and an adjustment peg is disposed within the bore. The adjustment peg is extended from the bore to level the flat bottom edge of the float stick on an uneven floor.

4 Claims, 5 Drawing Sheets

METHOD AND APPARATUS FOR MAKING SLOPED CONCRETE FLOORS

BACKGROUND OF THE INVENTION

1. Field of the Invention

This invention relates, generally, to methods and devices for making sloped concrete floors. More particularly, it relates to an apparatus including a plurality of sloped float sticks having a spirit level and a plurality of adjustment screws.

2. Description of the Prior Art

Many garage floors, outdoor patios, and other surfaces are made from concrete that is poured in a substantially level plane. However, the climate may be such that a sloped garage floor, patio, or other concrete surface is more desirable than a level one. The standard slope for a garage floor or patio is a one-eighth inch drop per linear foot.

One conventional method of making the slope is to mark a first end of the area to be sloped at the desired final height of that end and to mark a second end of the area to be sloped at the desired final height of that end. A straight strip of concrete or "mud" is then put down from the first mark to the second and a screed (a leveling device drawn over freshly poured concrete) is used to make that strip of concrete flat along its top as it slopes from the first end to the second end. Multiple parallel strips are spaced apart from one another by a predetermined distance as determined by the installer. The concrete strips are allowed to cure overnight. The area between the sloped strips is filled with concrete on the second day of the job and a screed tool is used again to complete the concrete part of the job. The floor or patio may be finished after the concrete has cured by overlying it with pavers, tile, paint or the like.

There are several disadvantages of that well-known method. The most important disadvantage is the fact that it expands any sloping job into a two day job. Moreover, the building of the properly sloped strips from concrete on the first day of the job is time-consuming.

Another method for making a sloped garage floor or patio avoids the need to make multiple sloped strips of concrete on the first day of the job. The function of the sloped concrete strips is instead performed by a plurality of wooden forms that have a flat bottom edge. The boards are disposed atop the flat surface with the flat bottom edge of each board overlying the flat surface of the garage floor or patio. The top edge surface of each board is pre-cut to include the desired one-eighth inch drop per linear foot. This well-known procedure requires precision sawing of the boards. Concrete is then poured between the forms and a screed is used to shape the top surface of the concrete to the contour presented by the sloped top edge surfaces of the boards.

The boards cannot be left in place so after the concrete has cured, the boards are removed, thereby leaving voids that must be filled with additional concrete that must be cured before the final surface is applied to the sloped floor. This procedure also requires a second day on the job site because the boards cannot be removed on the first day.

Moreover, if the floor is not level when the job is begun, the resulting sloped floor will not be sloped at the desired one-eighth inch to one foot pitch.

There is a need for an improved method of converting substantially level or unlevel concrete floors to concrete floors that are sloped at a predetermined slope. However, in view of the prior art considered as a whole at the time the present invention was made, it was not obvious to those of ordinary skill in the art that an improved method was needed. Nor was it obvious how the limitations of the prior art could be overcome.

SUMMARY OF THE INVENTION

The long-standing but heretofore unfulfilled need for an improved apparatus for making a sloped floor is now met by a new, useful, and non-obvious invention.

The novel tool facilitates changing a substantially level or an uneven or unlevel floor to a sloped floor having a predetermined slope. It includes a float stick of elongate configuration having a proximal end and a distal end. The float stick is formed of a rigid, cuttable material so that it can be cut to length as may be required by the size of the floor to be changed from substantially level or unlevel to said predetermined slope.

The float stick has a sloped top edge surface and a flat bottom edge surface. The sloped top edge surface slopes downwardly from the proximal end to the distal end at a predetermined slope per linear unit. A recess is formed in the upper edge of the float stick and a spirit level is positioned in the opening. The spirit level is calibrated so that its bubble is centered when the flat bottom edge surface of the float stick is substantially level.

At least one adjustment bore is formed in the float stick. In a preferred embodiment, a first bore is formed near a proximal end of a float stick and a second bore is formed near a distal end. Additional bores may be provided between the proximal and distal bores, depending upon the length of the float stick, i.e., a longer float stick will require more adjustment bores than a short float stick. Each adjustment bore extends from the top edge surface to the bottom edge surface of the float stick. An adjustment member is disposed within each bore and has a length that exceeds a length of its associated bore. Each adjustment member is formed of a cuttable material.

Each adjustment member has a retracted position where a leading end is flush with the bottom edge surface or retracted therefrom. Each adjustment member has an infinite plurality of extended positions where its leading end extends below the bottom edge surface when the float stick is supported by a floor. The adjustment members have an infinite plurality of extended positions where the respective leading ends of the adjustment members selectively extend below the bottom edge surface when the float stick is supported by a floor.

In a first embodiment, each bore has internal threads and the adjustment members have mating external threads. Each adjustment member has a tool-engageable head. For example, the head of each adjustment member may be slotted for engagement by a screwdriver, the periphery of each head may have flats formed therein for engagement by a wrench, each head may be formed integrally with a wing nut or other hand-engageable means, and the like.

In a second embodiment, parallel rings are formed along the extent of the adjustment members and mating parallel grooves are formed in the lumen of the bore. The adjustment member is advanced by manually pushing on it, and audible sounds are generated as the rings snap into and out of said grooves as the adjustment member is pushed against.

In a third embodiment, each bore may be smooth and each adjustment member may be a peg having a diameter slightly greater than a diameter of said bore so that the peg may be press fit therewithin. The adjustment member is then advanced by manually pushing on it. It retains its position when released due to the press fit.

Any number of contiguous float sticks may be connected in end-to-end relation to one another. The lowest end of a first float stick abuts the highest end of its contiguous float stick and said abutting sticks may be releasably attached to one another by a tongue and groove connection, a dovetail connection, a snap fit connection, or the like. In this way, any number of float sticks may be interconnected as needed and the last float stick may be foreshortened as needed by cutting.

The primary object of this invention is to provide a cost effective way to change a level or unlevel floor to a sloped concrete floor.

Another object is to advance the art by making a two day sloping job into a one day job by eliminating the need to build multiple sloped mud strips to serve as forms on a first day of a job.

Another object is to advance the art by making a two day sloping job into a one day job by eliminating the need to cut boards to shape that must be removed on a second day of a job.

Another object is to eliminate the use of mud strips and boards entirely, substituting light-in-weight float sticks formed of plastic or other suitable material for the mud strips or boards of the prior art.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
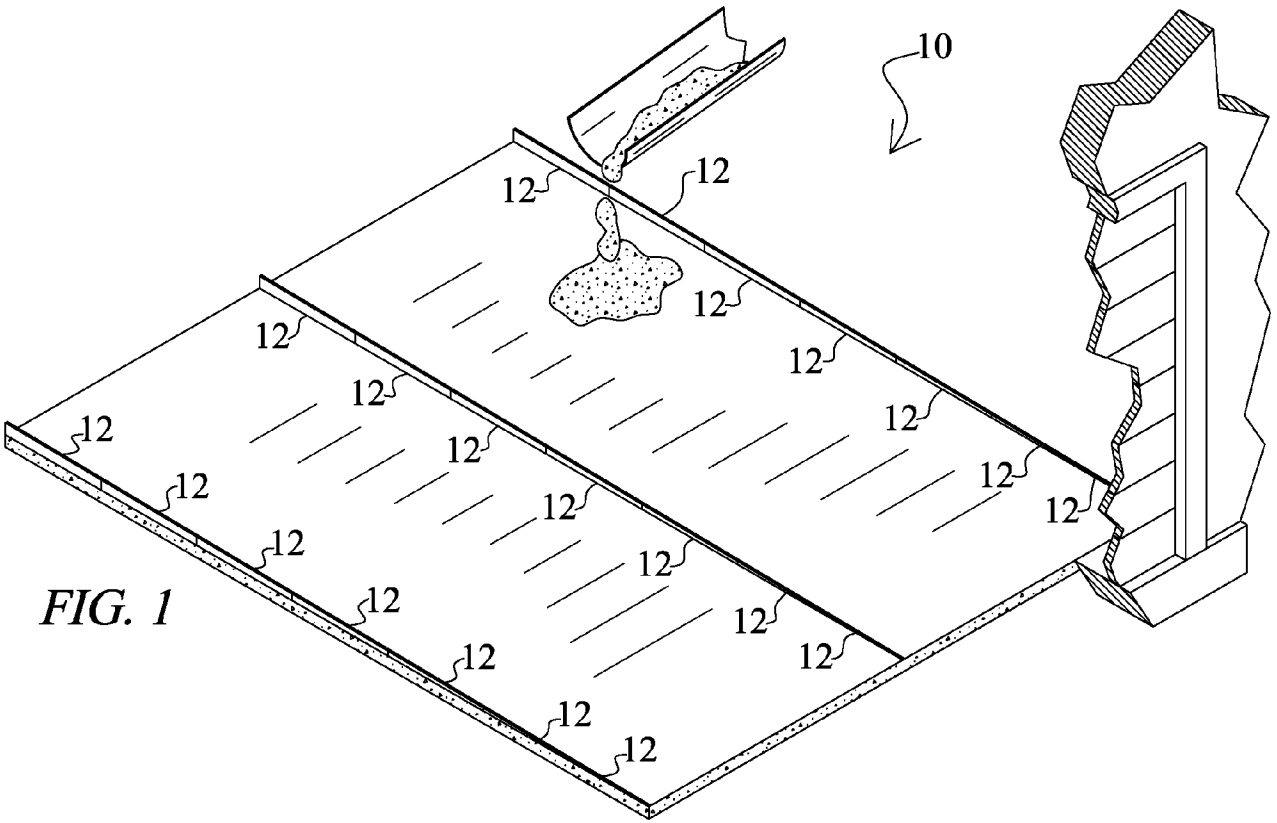
FIG. 1 is a perspective view of a substantially level garage floor that is to be modified to have a one-eighth inch to one linear foot slope.

Referring now to FIG. 1, it will there be seen that a substantially level garage floor having the novel float sticks, collectively denoted 12, arrayed in overlying relation thereto is denoted as a whole by the reference numeral 10. A closed garage door is depicted in cut-away view to indicate that the surface to which a slope is being added is a garage floor. However, the invention has utility in connection with patio and other floors to be sloped and is not restricted to garage floors.

Figure 2:
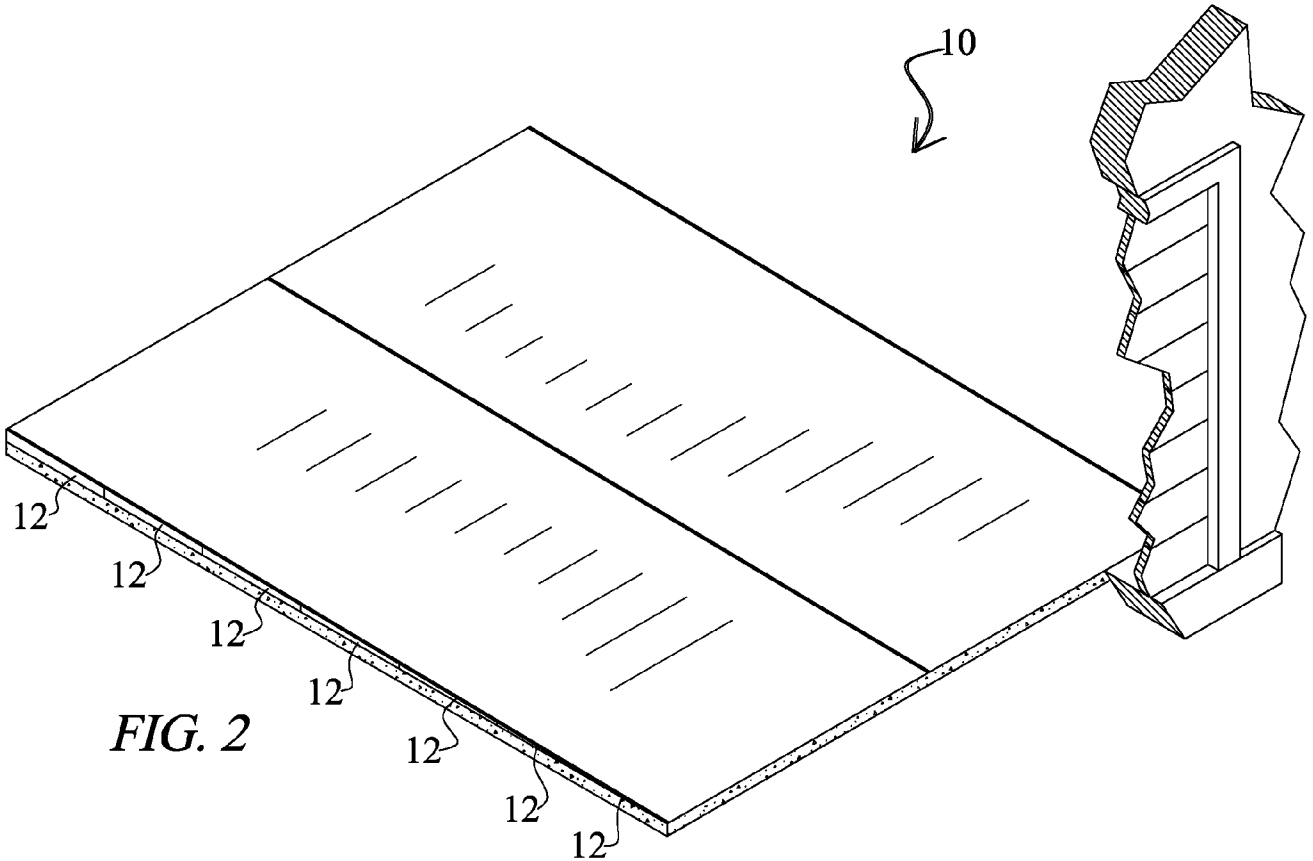
FIG. 2 is a perspective view depicting the finished garage floor with the novel tapered float sticks made a permanent part of the structure.

FIG. 2 is a perspective view depicting a finished sloped garage floor. Float sticks 12 are a permanent part of the finished structure and their respective top edges are visible until a final layer of finishing material, such as tile, a layer of acrylic, a coating or two of paint, or the like is applied thereto.

Figure 3:
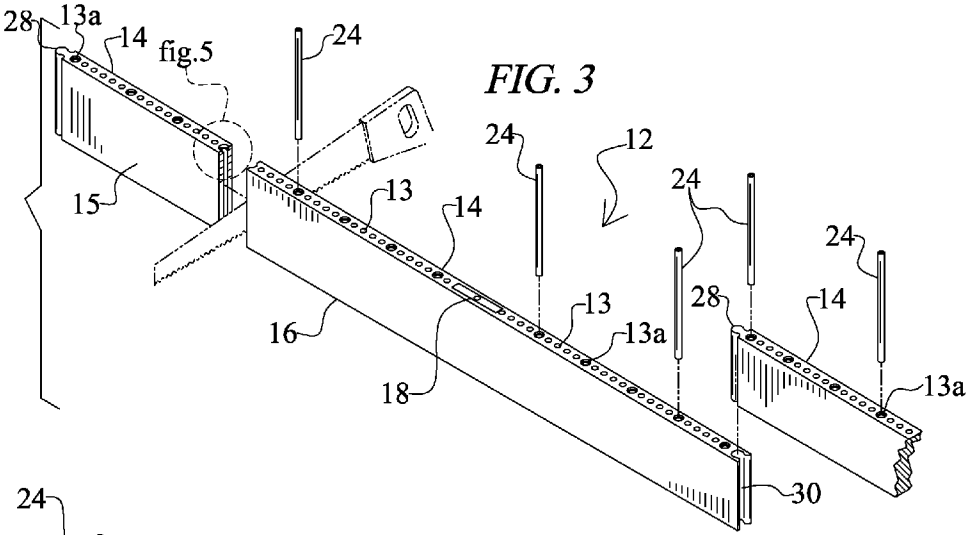
FIG. 3 is a perspective view of two float sticks, indicating that they can be cut to size and interconnected to one another in an end-to-end relation.

As indicated in FIG. 3, each float stick 12 has flat top edge surface 14 and bottom edge surface 16. Top edge surface 14 has a downward incline of one-eighth inch per linear foot. Inclines of one-quarter inch per linear foot as well as other inclines are within the scope of this invention. An incline of one-eighth inch per linear foot is exemplified because that is the standard slope for garage floors, outdoor patios, and the like. Such garage floors, outdoor patios, and the like are hereinafter referred to as floors and said floors are understood to be substantially level but seldom perfectly level.

Vertical bores 13 extend from top edge surface 14 to bottom edge surface 16. They are material-saving and bond-enhancing openings.

Each float stick 12 is preferably of plastic construction and is mass-produced so that users need not use mud and mud screeds or boards to create sloped forms. However, float sticks 12 can be made of any suitable material, including wood, and all such suitable materials are within the scope of this invention. The cost of a plastic float stick having the desired slope built into it is substantially less than the cost of the man-hours to build mud strips or the cost of a board and the expenses associated with cutting it to have the desired slope.

Each float stick 12 is preferably provided in lengths of one yard or one meter but it can be provided in differing lengths. Each float stick may also be cut as needed to fit a particular space as indicated in FIG. 3. For example, if a substantially level twenty feet (20') in length floor or patio is to be converted into a sloped floor or patio with float sticks that are three feet (3') in length, a first set of seven (7) of such float sticks are used along the length of such floor or patio with the last one being cut to a length of two feet (2'). In FIG. 3, the part of the last float stick requiring removal is denoted 15. A plurality of parallel, laterally spaced apart sets of the same structure is used to complete the job as depicted in FIGS. 1 and 2, the amount of lateral spacing between parallel sets being determined by the installer.

FIG. 3 depicts spirit level 18 mounted in a recess formed in top edge surface 14. The spirit level is calibrated so that it is centered when flat bottom edge surface 16 is level. FIG. 3 also depicts how contiguous float sticks are interconnected to one another in end-to-end relation. Tongue 28 and groove 30 are formed on opposite ends of each float stick in this embodiment. Other such quick-release connection means such as dovetail connections and the like are within the scope of this invention.

Figure 4:
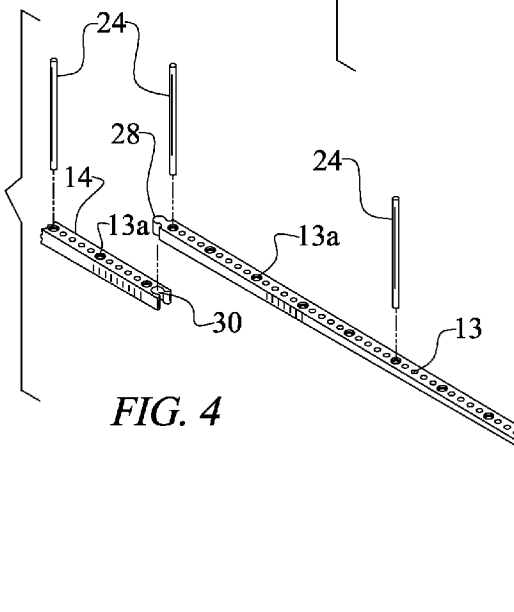
FIG. 4 is a perspective view of a thin float stick ending in a feather or slightly thicker edge that would form the lowermost end of a sloped garage floor or patio.

FIGS. 3 and 4 also indicate that some of the bores 13 may be countersunk as at 13*a*. In a preferred embodiment, every fifth bore 13 is countersunk but that spacing is not critical to the invention. None of the bores 13 have to be countersunk but the larger opening formed in top edge surface 14 by the countersink indicates to a user that the countersunk bore may be used to receive an adjustment peg, disclosed below.

FIG. 4 depicts a float stick 12 having a thin distal end. It is the first float stick to be positioned at the beginning of a sloping project.

Figure 5:
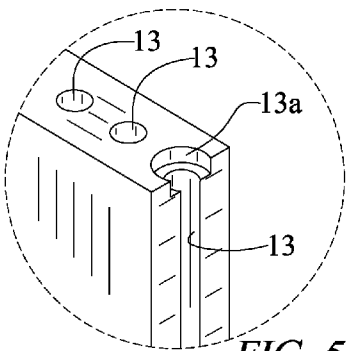
FIG. 5 is a cut-away perspective view showing a countersunk bore.

FIG. 5 is an enlarged view that better indicates countersink 13*a*.

Adjustment pegs 24 are used to position flat bottom edge surface 16 of a float stick 12 into a level configuration when said float stick lies atop an unlevel floor surface.

Figure 6A:
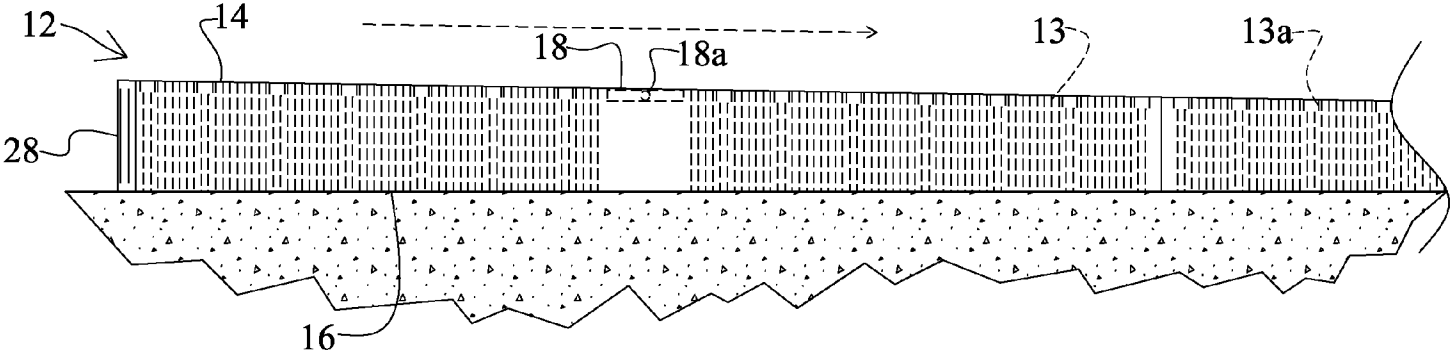
FIG. 6A is a side elevational view of the novel float sticks when used on a floor that is substantially level and having a top-mounted spirit level.

If a floor is perfectly level throughout its entire length and breadth, as depicted in FIG. 6A, spirit level 18 having bubble 18*a* is centered to indicate such level condition. In this somewhat rare situation, no adjustment pegs 24 are required.

Figure 6B:
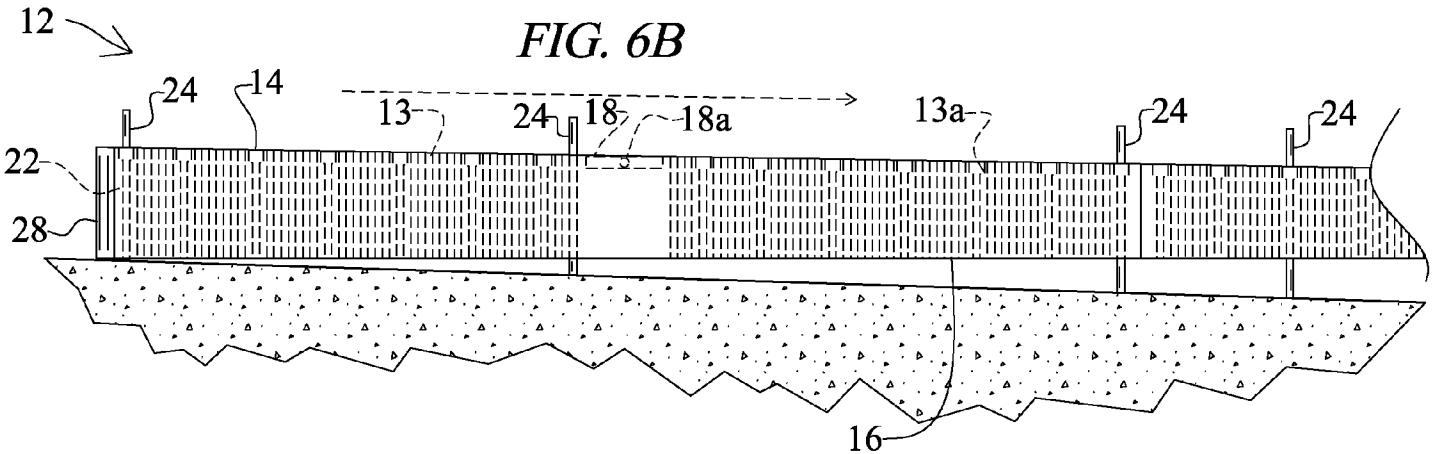
FIG. 6B is a side elevational view of a couple of float sticks when used on a floor that is not level.

When a floor is uneven as depicted in FIG. 6B, spirit level bubble 18*a* will be off center. One or more of adjustment pegs 24 is inserted into a selected bore 13 and advanced as required until spirit level bubble 18*a* is centered as depicted in said FIG. 6B. This positions float sticks 12 in the same configuration they would be in if the float sticks were supported by a level floor as in FIG. 6A, i.e., flat bottom edge surface 16 is now level and therefore flat top edge surface 14 is at the desired slope.

Figures 7, 8A, 8B, 8C:
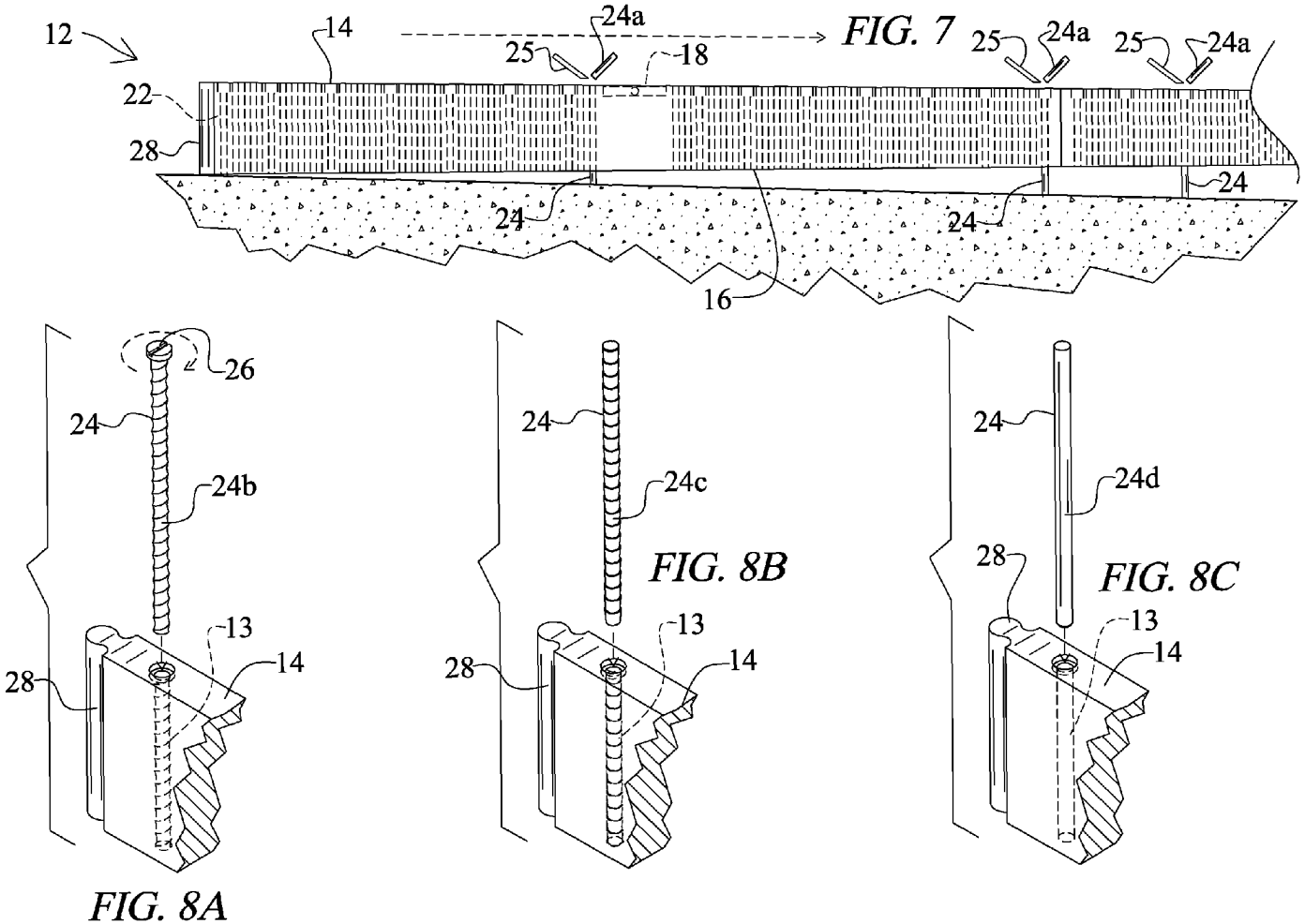
FIG. 7 is like FIG. 6B but indicates how the exposed tops of the adjustment members may be cut off so that the top edge of the float sticks is flush with the new concrete surface when the new concrete is poured.
FIG. 8A is a perspective view depicting a first embodiment where the adjustment members are externally threaded for screw-threaded engagement with their associated internally threaded adjustment bores.
FIG. 8B is a perspective view depicting a second embodiment where the adjustment members have external parallel rings formed thereon for mating engagement with their associated internally ringed adjustment bores.
FIG. 8C is a perspective view depicting a third embodiment where the adjustment members are press fit into their associated unthreaded and unringed adjustment bores.

Any length of an adjustment peg 24 that remains above top edge surface 14 after spirit level bubble 18*a* has been centered is cut off with a cutting tool 25 as depicted in FIG. 7. The uppermost end of an adjustment peg 24 that has been cut off is denoted 24*a*.

In a first embodiment, each adjustment peg 24 may be formed with external screw threads 24*b* as depicted in FIG. 8A and corresponding countersunk bore 13 is internally threaded.

In a second embodiment, depicted in FIG. 8B, adjustment peg 24 has a plurality of parallel, external rings 24*c* formed therein and corresponding internal, parallel rings are formed within each bore 13 along the length thereof. Audible clicks are heard as adjustment peg 24 is pushed into or pulled from its associated bore and the adjustment peg retains its position when released due to interlocking of said internal and external parallel rings.

In a third embodiment, adjustment pegs 24 and their associated bores 13 are unthreaded. Each unthreaded bore has a diameter slightly less than a diameter of its associated unthreaded adjustment peg. FIG. 8C depicts unthreaded adjustment peg 24*d* and unthreaded bore 13. Adjustment peg 24*d* is press fit into its associated bore 13 and is retractable and extendable by being pulled from or pushed into, respectively, said bore. In all other respects, this third embodiment is used in the same way as the first and second embodiments.

Each adjustment peg 24 may be provided with a tool-engageable head 26 as depicted in FIG. 8A. Head 26 may be engaged by screwdrivers, hex keys and the like. Tool-engageable head 26 fits with countersunk area 13*a* and limits the amount by which an adjustment peg 24 may be advanced.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A tool for changing an unlevel floor to a sloped floor having a predetermined slope, comprising:

a float stick of elongate configuration having a proximal end and a distal end;

said float stick formed of a rigid, cuttable material so that it can be cut to length as may be required by the size of the floor;

said float stick having a sloped top edge surface and a flat bottom edge surface, said sloped top edge surface sloping downwardly relative to said flat bottom edge surface from said proximal end to said distal end at a predetermined slope per linear unit;

a recess formed in said sloped top edge surface;

a spirit level positioned in said recess and calibrated so that a bubble of said spirit level is centered when said flat bottom edge surface is substantially level;

at least one bore formed in said float stick, said bore extending from said sloped top edge surface to said flat bottom edge surface;

an adjustment peg disposed within said at least one bore, said adjustment peg having a length that exceeds a length of said at least one bore and said adjustment peg being formed of a cuttable material;

said adjustment peg having a retracted position where a leading end of said adjustment peg is flush with said flat bottom edge surface; and said adjustment peg having at least one extended position where said leading end of said adjustment peg extends below said flat bottom edge surface when said float stick is supported by said unlevel floor, and said adjustment peg being extended by a distance required to make said flat bottom edge surface level as indicated by said spirit level.

2. The tool of claim 1, further comprising:

said at least one bore having internal threads and said adjustment peg having external threads.

3. The tool of claim 1, further comprising:

said at least one bore having internal, parallel rings formed therein; and a plurality of external, parallel rings formed along the length of said adjustment peg;

whereby audible clicks are heard as said adjustment peg is pushed into or pulled from said at least one bore; and whereby said adjustment peg retains its position when released due to interlocking of said internal and external parallel rings.

4. The tool of claim 1, further comprising:

said at least one bore having a smooth lumen;

said at least one adjustment peg having a diameter slightly greater than a diameter of said lumen;

whereby said at least one adjustment peg retains its position when released due to a press fit engagement between said at least one adjustment peg and said smooth lumen.

* * * * *